United States Patent [19]

Meret

[11] Patent Number: 4,911,081

[45] Date of Patent: Mar. 27, 1990

[54] GUIDED VEHICLE WITH STEERED AXLES

[75] Inventor: Laurent Meret, Brunoy, France

[73] Assignee: Regie Autonome des Transports Parisiens, France

[21] Appl. No.: 206,965

[22] Filed: Jun. 9, 1988

Related U.S. Application Data

[63] Continuation of Ser. No. 877,845, Jun. 24, 1986, abandoned.

[30] Foreign Application Priority Data

Jun. 26, 1985 [FR] France ..... 85 09708

[51] Int. Cl.[4] ..... B61F 5/00

[52] U.S. Cl. ..... 105/168

[58] Field of Search ..... 105/165, 167, 168, 169, 105/130, 136; 295/38, 37, 36 R; 303/106

[56] References Cited

U.S. PATENT DOCUMENTS

| | | | |
|---|---|---|---|
| 962,398 | 6/1910 | Young | 105/130 |
| 1,059,102 | 4/1913 | Armstrong | 105/169 |
| 2,036,194 | 4/1936 | Burrows et al. | 105/132.1 |
| 3,850,480 | 11/1974 | Atkins | 303/106 |
| 4,071,282 | 1/1978 | Callahan et al. | 303/106 |
| 4,164,188 | 6/1979 | Hallem et al. | 105/168 |
| 4,444,120 | 4/1984 | Bille | 295/37 |

FOREIGN PATENT DOCUMENTS 2526387 5/1982 France .

*Primary Examiner*—Margaret A. Focarino
*Assistant Examiner*—Frank H. Williams, Jr.

[57] ABSTRACT

This invention relates to a guided vehicle such as a railway vehicle and is a development or improvement of the invention disclosed in patent specification No. 2 526 387. The vehicle has steerable axles, each of which is steered by a coupling bar connected to the axle mount at a contact point and pivoted on the body of the vehicle at a pivot point. The axle mount is mounted on the body for rotation about an axis of rotation. The distances between the pivot point, the axis of rotation and the contact point, and the length of the coupling bar d are chosen to position the axle radially of a curve, as in the earlier patent specification. The pivot point of the coupling bar on the body is arranged to be substantially on the roll axis of the vehicle. Each drive axle has independently rotatable wheels and a limited slip differential limits the relative slip to 5%. The non-driven axles may also have independently rotating wheels, and anti-skid, anti-wheel-spin electronic control of the wheel brakes. The invention is especially applicable to railway vehicles for use on tracks with small radius curves such as urban railways.

10 Claims, 3 Drawing Sheets

GUIDED VEHICLE WITH STEERED AXLES

This application is a continuation of application Ser. No. 877,845, filed June 24, 1986, now abandoned.

BACKGROUND OF THE INVENTION

The present invention relates to a guided vehicle having steered axles and particularly but not exclusively to a railway train in which the axles are steered to position them radially in the curves of the track. The present invention is a development or improvement of the invention disclosed in French patent No 2 526 387.

DESCRIPTION OF THE PRIOR ART

The vehicle disclosed in the earlier patent specification comprises a body, first and second axles each comprising two wheels, first and second mount members bearing said body and mounted on said first and second axles respectively, said mount members being mounted pivotally to said body to rotate about respective first and second axes of rotation, first and second coupling members for coupling said vehicle to further vehicles at respective coupling points, said coupling members being mounted on said body to pivot about respective pivot points and being connected to said mount members at respective contact points whereby to steer said mount members and said axles, the distance a between said first and second axes of rotation, the distance n between said pivot point of each coupling member and the axis of rotation of the corresponding mount member, the distance b between said axis of rotation and said contact point and the distance d between said coupling point and said pivot point of each coupling member satisfying substantially the equation:

$$b = n + \frac{na}{2(n + d)}$$

This enables the axles to be steered to a position radial to the curve on which the train is running with a very close accuracy, that is to say that the steer angle of each axle is substantially equal to half the angle subtended by the two axes of rotation of the mounts at the center of curvature of the curve.

Advantageously, resilient suspension members are interposed between each axle and its corresponding mount member.

Trains, and especially railway trains, can be subjected to a roll movement which is a low amplitude oscillation about a central longitudinal axis parallel to the track, the roll movement being caused or amplified by defects in the track geometry in certain sections.

Such a roll movement causes a displacement of the pivot point of the coupling bar with the body and this displacement can disturb the radial positioning of the corresponding axle.

The radial positioning of the axle may also be disturbed by slipping or spinning of at least one wheel when running in a curve, especially if the two wheels are solid with the same axle.

The earlier patent specification did not disclose steering the endmost axles of the train, as the steering disclosed of one axle was obtained jointly with the steering of an axle of the next vehicle.

OBJECTS OF THE INVENTION

It is an object of the invention to provide improved steering of axles in a train of vehicles.

It is another object of the invention to improve the steering of axles in a vehicle when the vehicle rolls.

It is yet another object of the invention to provide improved steering of the axle during wheel slip or spin conditions.

Still another object of the invention is to provide steerage for the endmost axles of a train.

BRIEF DESCRIPTION OF THE INVENTION

In a vehicle of the kind described above, the present invention provides a guided vehicle comprising a body, first and second axles each comprising two wheels, first and second mount members bearing said body and mounted on said first and second axles respectively, said mount members being mounted pivotally to said body to rotate about respective first and second axes of rotation, first and second coupling members for coupling said vehicle to further vehicles at respective coupling points, said coupling members being mounted on said body to pivot about respective pivot points and being connected to said mount members at respective contact points, whereby to steer said mount members and said axles, the distance a between said first and second axes of rotation, the distance n between said pivot point of each coupling member and the axis of rotation of the corresponding mount member, the distance b between said axis of rotation and said contact point, and the distance d between said coupling point and said pivot point of each coupling member satisfying substantially the equation:

$$b = n + \frac{na}{2(n + d)}$$

said pivot point of each said coupling member on said body being disposed substantially in the roll axis of said vehicle.

DESCRIPTION OF THE DRAWINGS

Other features and advantages of the invention will appear from the following description, given by way of example with reference to the accompanying drawings, in which.

DESCRIPTION OF THE PREFERRED EMBODIMENT OF THE INVENTION

Figure 1:
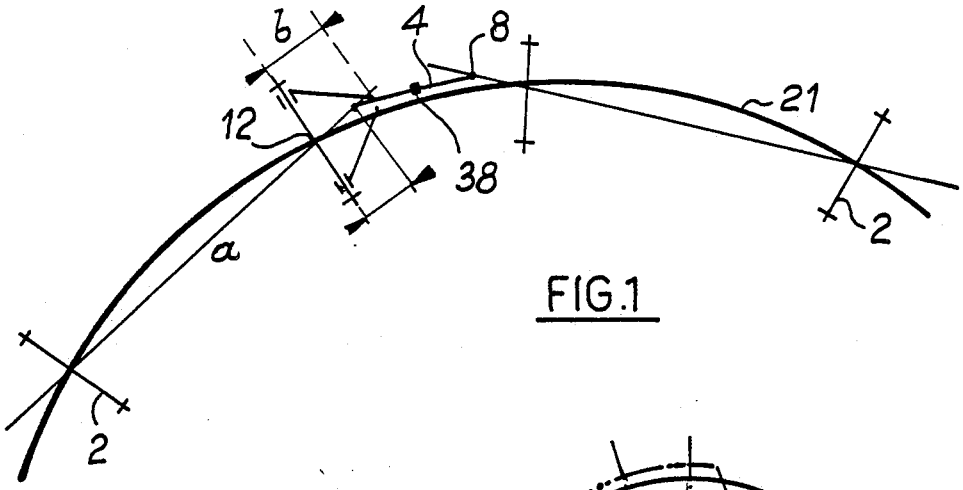
FIG. 1 is a schematic plan view diagram showing a vehicle with radial steering apparatus in accordance with the present invention.

FIG. 1 shows schematically a train having radial axle steering apparatus as disclosed in French patent 2 526

387 moving along a curve whose mean radius is indicated at 21. The train comprises two guided vehicles each comprising two steerable axles 2 and coupled together by two coupling bars 4. The coupling bar 4 comprises a pivot point 8 and the corresponding axle 2 has an axis of rotation 12, the distance between the pivot point 8 and the axis 12 being indicated by n; the length of the coupling bar 4 of each vehicle is d; the distance between the two axes of rotation 12 on the same vehicle is a; the coupling bar 4 contacts the end-piece of the vehicle at a point 11, the distance between the contact point 11 and the axis of rotation 12 being b; In accordance with the invention of the earlier patent specification, these parameters are chosen to satisfy substantially the following equation:

$$b = n + \frac{na}{2(n + d)}$$

This enables the steering apparatus to maintain the axle 2 substantially radially relative to the curve 21.

Figure 2:
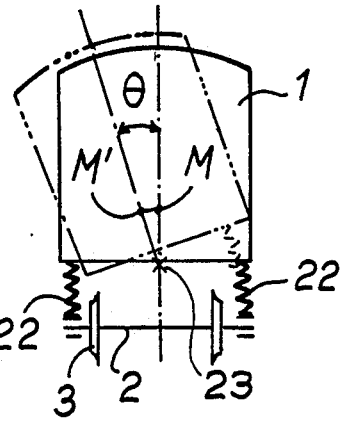
FIG. 2 is an end view of the vehicle showing the effect of roll.

FIG. 2 shows the effect of roll of the vehicle. Since the connection of the body and the axles is not rigid but is ensured by resilient suspension members 22, the body can rotate about a central longitudinal axis 23 referred to as the roll axis; the angle of inclination of the body relative to the axle 2 is referred to as the roll angle $\theta$.

During a roll displacement, a point M on the central longitudinal plane of the vehicle is displaced horizontally to a maximum position M', this displacement being approximately equal to the product of the distance of the point M from the roll axis 23 multiplied by the roll angle $\theta$ in radians. In the steering apparatus disclosed in the earlier patent specification, the point 8 where the coupling bar 4 is attached to the body 1 is subjected to a horizontal displacement and consequently the coupling bar is displaced angularly in the horizontal plane, which disturbs the radial positioning of the axle 2. The angular displacement of the coupling bar causes rotation of the axle which can maintain the roll displacement, the body oscillating about its normal position.

In accordance with this embodiment of the present invention, this disturbance of the radial positioning of the axles of a vehicle which is subjected to roll is avoided by positioning the pivot point 8 of the coupling bar 4 on the body 1 substantially in the roll axis 23 of the vehicle. In this way, during a roll movement, the first point 8 does not move relative to the axle and the axle remains in a radial position.

The alignment of the pivot point 8 of the coupling bar 4 with the roll axis may be achieved by leading the pivot point to the level of the roll axis by modifying the structure of the coupling bar. Alternatively, the roll axis may be changed, by placing the pivot points of the suspension members 22 at a level such that the roll axis 23 passes substantially through the pivot point 8 of the coupling bar to the body.

Figure 3:
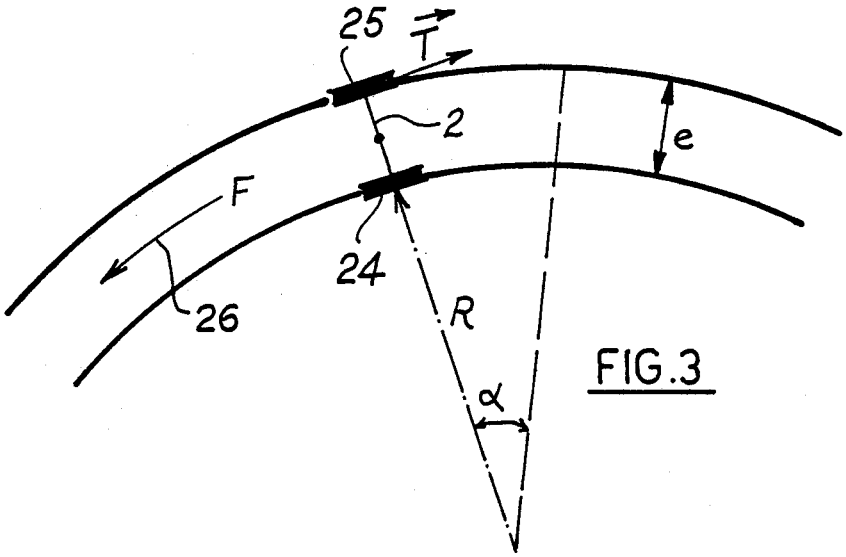
FIG. 3 is a plan view diagram showing the effect of wheel slip in the vehicle.

FIG. 3 shows schematically two rails in a curve on which is moving an axle 2 having an inner wheel 24 and an outer wheel 25. The axle 2 may be a conventional railway axle, that is to say that the two wheels 24 and 25 are solid with the axle 2 and always rotate at the same speed. When the axle 2 runs along curved rails, the inner and outer wheels do not run the same distance and it follows that there must be a slippage of the outer wheel for instance equal to e/R, e being the track width and R the radius of curvature of the inner rail. For small radius curves which may in particular be the case of urban railways, the slip can attain a value of 5% which corresponds to a track width of 1.5 meters and a radius of curvature equal to 30 meters.

Slip of the outer wheel produces a drag T opposing the forward motion, as indicated by the arrow F; this produces a torque which tends to oppose radial positioning of the axle 2, corresponding to a tendency to steer straight on.

Figure 4:
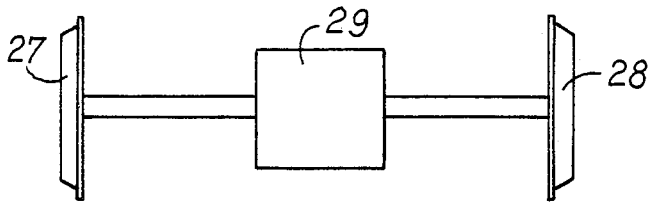
FIG. 4 is an end view of an independent wheel axle in a first embodiment of the vehicle.

In accordance with this embodiment of the present invention, each drive axle comprises independently rotatable wheels and means for limiting the relative slip of the wheels. This function may be obtained as shown in FIG. 4 where the axle 2 comprises two half-axles 27 and 28 which are connected to a differential 29 whose slip is limited for example to 5%.

Figure 5:
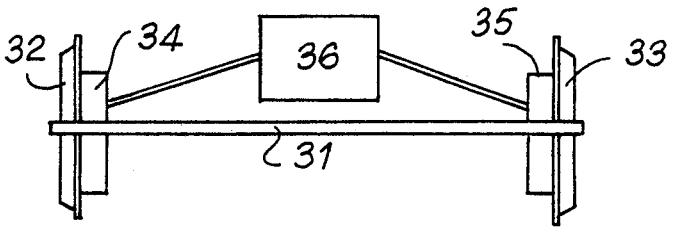
FIG. 5 is an end view of an independent wheel axle in a second embodiment of the vehicle.

In another embodiment of the present invention, as shown in FIG. 5, each axle comprises a dead axle 31 bearing idling wheels 32 and 33 each having a respective brake apparatus 34 and 35; an electronic apparatus shown schematically at 36 controls the speed of rotation of each of the wheels 32 and 33 and acts on the brakes 34 and 35 to equalize the net torque on the two wheels, either by braking a wheel which tends to spin when driven or by modulating the brake torque of a wheel which tends to slip under braking with an "anti-skid" function.

Referring again to FIG. 1, the length of the vehicle E is given by:

$$E = a + 2d + 2n$$

The length E is usually pre-determined and cannot be varied to adjust the radial positioning.

Also, problems relating to the design of a passage for movement of passengers between adjacent carriages fix the length d of a coupling bar to within a few centimeters and this parameter can practically not be varied either. This leaves three parameters which can be varied, namely the lengths a, b and n, these parameters being related by the requirement for radial positioning but also by the above equation defining the overall vehicle length which is fixed in advance.

The three parameters left are therefore related by two equations; this enables one of the parameters to be selected at will.

In accordance with an embodiment of the invention, the parameter n, that is to say the distance between the axis of rotation 12 of the axle from the pivot point of the coupling bar is defined by the following equation:

$$n = \frac{-a + \sqrt{4d^2 + a^2}}{2}$$

It then follows that the parameters a, n and d are fixed, given the previous equations.

Figure 6:
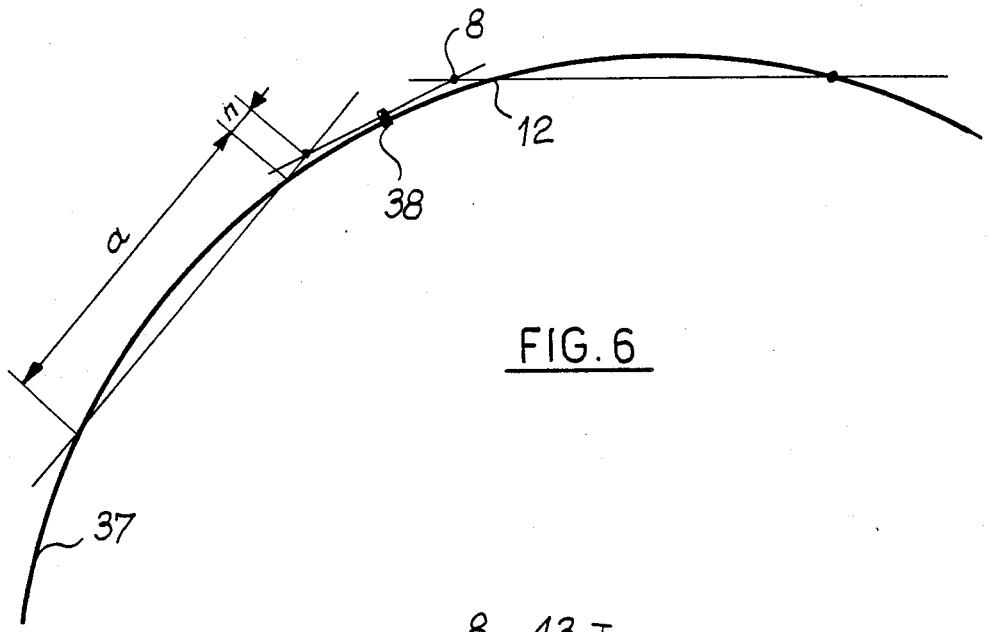
FIG. 6 is a plan view diagram of an embodiment of the steering apparatus in which the coupling bar is tangent to the track axis.
Figure 7:
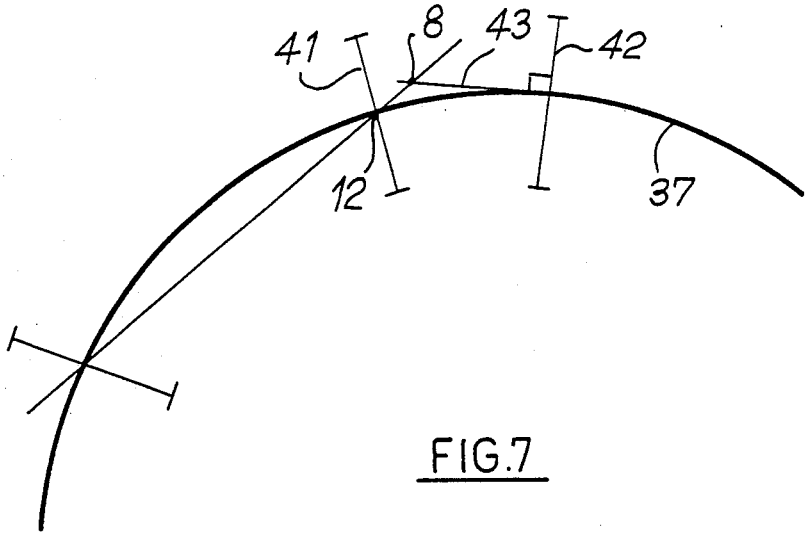
FIG. 7 is a plan view diagram of an embodiment of the steering apparatus of an end axle of a train.

This last equation translates the fact that the coupling bar 4 is tangential to the median axis 37 of the track, that is to say to a curve equidistant from the two rails. This is illustrated in FIG. 6 which shows the two coupling bars 4 tangent to the track axis 37, the point of contact being the mid-point of the coupling, that is to say the point 38 where the two coupling bars are connected together. This is obtained whatever the radius of curvature of the track.

In a preferred embodiment of the invention, this last equation is respected and, for the guidance of the end-most axles, that is to say the axles at the ends of the train, each end load-bearing axle 41 is provided with an additional steering axle 42 which is disposed beyond the end of the train, that is to say on the side of the end load-bearing axle opposite to the second load-bearing axle of the vehicle; also, the coupling bar 43 of the end load-bearing 41 is fixed at one end onto the middle of the steering axle 42 and perpendicularly thereto.

In this way, the steering axle 42 automatically maintains the free end of the coupling bar 43 on the axis of the track 37. This coupling bar therefore is maintained in the tangential position of FIG. 6. Given that the other equation relating the parameters a, b, d and n, as mentioned in the earlier patent specification, are respected, automatically radial positioning is achieved for all the axles of the whole train.

The embodiments of the invention described above enable radial positioning of all the axles of a railway train independently of roll movement of the train during its passage round a curve.

The invention is particularly, but not exclusively, applicable to railway vehicles for use on tracks including small radius curves, which is the case in particular for urban trains.

I claim:

1. A guided vehicle comprising a body, first and second axles each comprising two wheels, first and second mount members bearing said body and mounted on said first and second axles respectively, and being adapted to traverse a curved track having a mean radius, said mount members being mounted pivotally to said body to rotate about respective first and second axes of rotation, said vehicle having a roll axis, first and second coupling means for coupling said vehicle to further vehicles at respective coupling points so that during a roll movement of said vehicle the coupling point associated with said each coupling means does not move relative to an adjacent axle far enough to disturb the radial positioning of the adjacent axle relative to the curved track, said coupling means being mounted on said body to pivot about respective pivot points and being connected to said mount members at respective contact points whereby to steer said mount members and said first and second axles, the distance a between said first and second axes of rotation, the distance n between said pivot point of each coupling member and the axis of rotation of the corresponding mount member, the distance b between said axis of rotation and said contact point, and the distance d between said coupling point and said pivot point of each coupling member satisfying substantially the equation:

$$b = n + \frac{na}{2(n + d)}$$

said pivot point of each said coupling means on said body being disposed at least immediately adjacent to the roll axis of said vehicle.

2. A vehicle as claimed in claim 1, and including resilient suspension members interposed between said mount members and the respective axles, whereby said roll axis of the vehicle is disposed substantially at the height of said coupling member.

3. A vehicle as claimed in claim 1, wherein said wheels of at least one of said axles are mounted for rotation independently of each other, the vehicle including drive means for driving said wheels, said drive means including motor means and limited slip means for enabling a limited difference of rotational speed between the wheels of said at least one axle.

4. A vehicle as claimed in claim 3, wherein said limited slip means comprises a limited slip differential for transmitting torque from said motor to said wheels.

5. A vehicle as claimed in claim 4, wherein said limited slip means limits said difference of rotational speed to 5%.

6. A vehicle as claimed in claim 3, wherein said limited slip means limits said difference of rotational speed to 5%.

7. A vehicle as claimed in claim 1 and including respective brake means for said wheels of at least one axle, and brake control means for adjusting the brake torque applied by said brake means, whereby to tend to equalise torque applied to said wheels of said at least one axle.

8. A vehicle as claimed in claim 1, wherein said distances a, d and n satisfy the equation:

$$n = \frac{-a + \sqrt{4d^2 + a^2}}{2}$$

9. A vehicle as claimed in claim 8 for use at the end of a train, and including a further steering axle disposed beyond said first axle at a free end of the vehicle, said coupling bar of said first axle being connected at a midpoint on said steering axle with said steering axle extending perpendicularly to said coupling bar.

10. A vehicle as claimed in claim 1 for use at the end of a train, and including a further steering axle disposed beyond said first axle at a free end of the vehicle, said coupling bar of said first axle being connected at a midpoint on said steering axle with said steering axle extending perpendicularly to said coupling bar.

* * * * *

UNITED STATES PATENT AND TRADEMARK OFFICE

CERTIFICATE OF CORRECTION

PATENT NO. : 4,911,081

DATED : March 27, 1990

INVENTOR(S) : Laurent Meret

It is certified that error appears in the above-identified patent and that said Letters Patent is hereby corrected as shown below:

Column 3, line 10. after "piece" insert --5--.

In the Drawings of Fig. 1

The drawing of this Figure should be labelled as "Prior Art".

An arrow head should be shown at each end of the line designated a and showing the distance between two axes of rotation 12 on the same vehicle.

Reference numeral n should be applied to show the distance between the pivot point 8 and the axis of rotation 12 on the same vehicle.

Reference numeral d should be applied to show the length of coupling bar 4 of a vehicle.

Reference numeral 5 should be applied to the end-piece of a vehicle.

Reference numeral 11 should be applied to the point where the coupling bar 4 of a vehicle contacts the end-piece of the vehicle.

UNITED STATES PATENT AND TRADEMARK OFFICE

CERTIFICATE OF CORRECTION

PATENT NO. : 4,911,081

DATED : March 27, 1990

INVENTOR(S) : Laurent Meret

It is certified that error appears in the above-identified patent and that said Letters Patent is hereby corrected as shown below:

In the Drawing of Fig. 3

Reference numeral 2 should be applied to the axle of the vehicle.

In the Drawing of Fig. 6

Reference numeral 4 should be applied to the coupling bar.

Signed and Sealed this

Fourth Day of June, 1991

*Attest:*

*Attesting Officer*

HARRY F. MANBECK, JR.

*Commissioner of Patents and Trademarks*